US009605610B2

(12) United States Patent
Dudar

(10) Patent No.: US 9,605,610 B2
(45) **Date of Patent: *Mar. 28, 2017**

(54) SYSTEM AND METHODS FOR PURGING A FUEL VAPOR CANISTER

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 345 days.

This patent is subject to a terminal disclaimer.

(21) Appl. No.: 14/301,246

(22) Filed: Jun. 10, 2014

(65) Prior Publication Data

US 2015/0354478 A1 Dec. 10, 2015

(51) Int. Cl.
*F02D 41/00* (2006.01)
*F02M 25/08* (2006.01)

(52) U.S. Cl.
CPC ..... *F02D 41/003* (2013.01); *F02M 25/0809* (2013.01)

(58) Field of Classification Search
CPC ..... F02D 41/00; F02D 41/004; F02D 41/24; F02D 41/2406; F02D 41/26; F02M 25/08; F02M 25/0809; F02M 25/0836; F02M 25/0854; F02M 25/0863; F02M 25/0872
USPC ..... 701/102–104, 110–114; 123/516–521
See application file for complete search history.

(56) References Cited

U.S. PATENT DOCUMENTS

| | | | | |
|---|---|---|---|---|
| 3,888,223 | A * | 6/1975 | Mondt | F02M 25/089 123/519 |
| 5,183,023 | A | 2/1993 | Hanson | |
| 5,918,580 | A | 7/1999 | Hennrich et al. | |
| 6,293,261 | B1 * | 9/2001 | Oemcke | F02M 25/0854 123/516 |
| 7,267,112 | B2 | 9/2007 | Donahue et al. | |
| 7,284,541 | B1 | 10/2007 | Uchida et al. | |
| 8,371,273 | B2 | 2/2013 | Ulrey | |
| 8,435,334 | B2 | 5/2013 | Hart et al. | |
| 2002/0124836 | A1 * | 9/2002 | Reddy | F02M 25/08 123/518 |
| 2009/0084363 | A1 * | 4/2009 | Reddy | F02M 25/0854 123/520 |
| 2010/0223984 | A1 * | 9/2010 | Pursifull | F02M 25/0836 73/114.39 |
| 2011/0030659 | A1 * | 2/2011 | Ulrey | F02M 25/089 123/521 |
| 2014/0257668 | A1 * | 9/2014 | Jentz | F02M 25/0809 701/102 |

* cited by examiner

*Primary Examiner* — John Kwon
*Assistant Examiner* — Johnny H Hoang
(74) *Attorney, Agent, or Firm* — James Dottavio; John D. Russell; B. Anna McCoy

(57) ABSTRACT

A method for purging a fuel vapor canister, comprising: responsive to a canister load decreasing below a first threshold, reversing a direction of air flow through the fuel vapor canister while maintaining purge air intake at a vent line inlet. By reversing the direction of air flow through the fuel vapor canister, canister regions that would normally retain fuel vapor during a purge event may realize increased desorption when the air flow direction is reversed. In this way, the efficiency of a purge event may be increased and bleed emissions may be reduced.

20 Claims, 5 Drawing Sheets

SYSTEM AND METHODS FOR PURGING A FUEL VAPOR CANISTER

BACKGROUND AND SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve coupled between the engine intake and the fuel canister is opened, allowing for intake manifold vacuum to be applied to the fuel canister. Simultaneously, a canister vent valve coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

However, fresh air flow within and through the canister is not uniform. Regions of adsorbent that see relatively less air flow will retain relatively more adsorbed hydrocarbons. Typically, 10-15% of the canister will retain some quantity of hydrocarbons following a purge operation, and this amount may increase as the canister ages. The residual hydrocarbons may desorb over a diurnal cycle, leading to an increase in bleed emissions. Strategies to limit these bleed emissions have included secondary canisters and heating elements, both of which increase manufacturing costs and require additional diagnostic testing.

The inventors herein have recognized the above issues and have developed systems and methods to at least partially address them. In one example, a method for purging a fuel vapor canister, comprising: responsive to a canister load decreasing below a first threshold, reversing a direction of air flow through the fuel vapor canister while maintaining purge air intake at a vent line inlet. By reversing the direction of air flow through the fuel vapor canister, canister regions that would normally retain fuel vapor during a purge event may realize increased desorption when the air flow direction is reversed. In this way, the efficiency of a purge event may be increased and bleed emissions may be reduced.

In another example, a method for purging a fuel vapor canister, comprising: coupling a first fuel vapor canister port to an engine intake; coupling a second fuel vapor canister port to a fresh air source; opening a canister purge valve coupled between the first fuel vapor canister port and the engine intake; and responsive to a fuel vapor canister load decreasing below a first threshold, coupling the second fuel vapor canister port to the engine intake and coupling the first fuel vapor canister port to the fresh air source. In this way, when purge flow has plateaued in a first direction, the flow of fresh air through the canister may be reversed, providing uniform purging throughout the canister.

In yet another example, a system for an engine, comprising: a fuel vapor canister comprising a fuel vapor canister buffer; a purge line coupling the fuel vapor canister to an engine intake via a canister purge valve; a vent line coupling the fuel vapor canister to a fresh air source; a canister vent valve coupled between the fuel vapor canister and the vent line, the canister vent valve operable between a first conformation and a second conformation; a reversing valve coupled between the fuel vapor canister buffer and the purge line, the reversing valve operable between a first conformation and a second conformation; and a controller comprising instructions stored in non-transitory memory, that when executed, cause the controller to: draw air through the fuel vapor canister with the canister vent valve in the first conformation and with the reversing valve in the first conformation; responsive to a fuel vapor canister load decreasing below a first threshold, draw air through the fuel vapor canister with the canister vent valve in the second conformation and with the reversing valve in the second conformation; and responsive to the fuel vapor canister load decreasing below a second threshold, lower than the first threshold, ceasing drawing air through the fuel vapor canister. In this way, bleed emissions may be reduced without requiring additional elements which may increase manufacturing costs, such as a canister heater or secondary bleed canister.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows an example vehicle propulsion system.

FIG. 2 schematically shows an example vehicle system with a fuel system and an evaporative emissions system.

FIGS. 3A-3C schematically show a vehicle evaporative emissions system in various states of operation.

DETAILED DESCRIPTION

Figure 2:
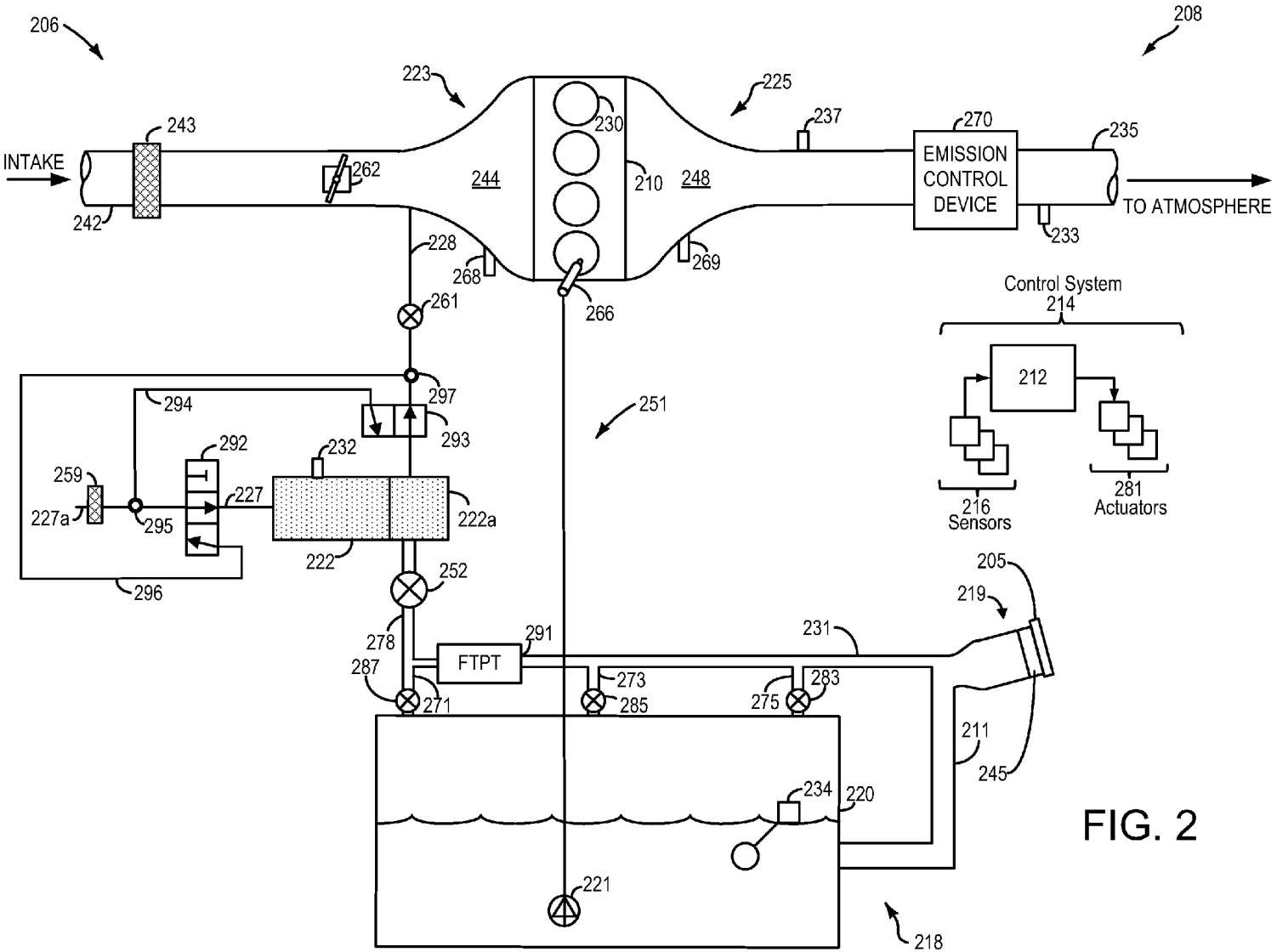
Figure 3A:
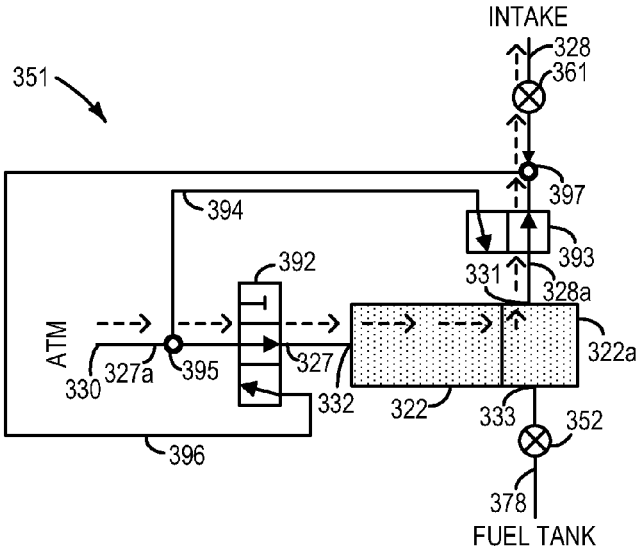
Figure 3B:
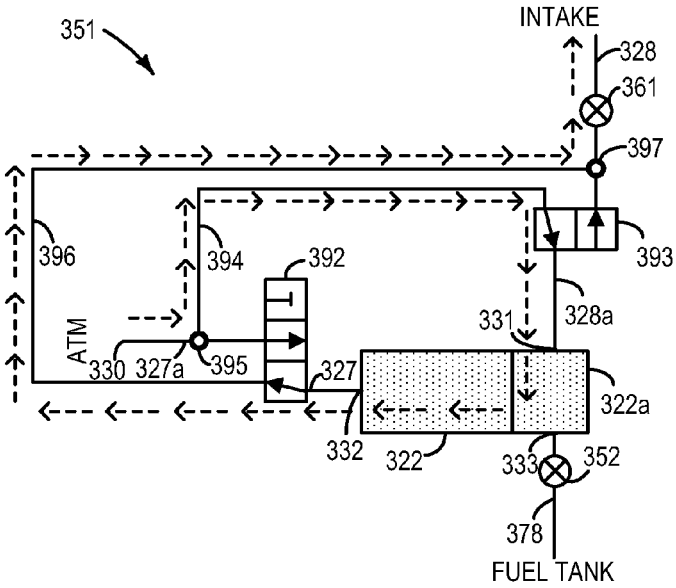
Figure 3C:
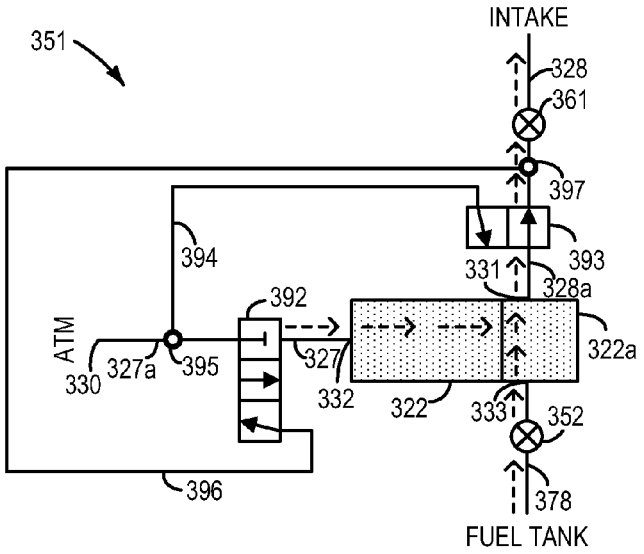

This detailed description relates to systems and methods for managing fuel vapor in an evaporative emissions system. In particular, the description relates to reversing air flow through a fuel vapor canister in order to increase the desorption of fuel vapor stored in the canister. The evaporative emissions system may be included in a hybrid vehicle, such as the hybrid vehicle system depicted in FIG. 1. The vehicle may include an engine system and fuel system coupled to the evaporative emissions system, as shown in FIG. 2. The evaporative emissions system may include a fuel vapor canister coupled to a fuel tank such that fuel vapor may be discharged from the fuel tank without entering the atmosphere. The stored fuel vapor may be purged to intake with fresh air drawn from atmosphere. FIGS. 3A-3C show depictions of an example fuel vapor canister and a system of conduits and valves for controlling the direction of fresh air through the canister. Stored fuel vapor may be purged from the canister using the method depicted in FIG. 4. FIG. 5 shows an example timeline for a purge operation using the method of FIG. 4.

Figure 1:
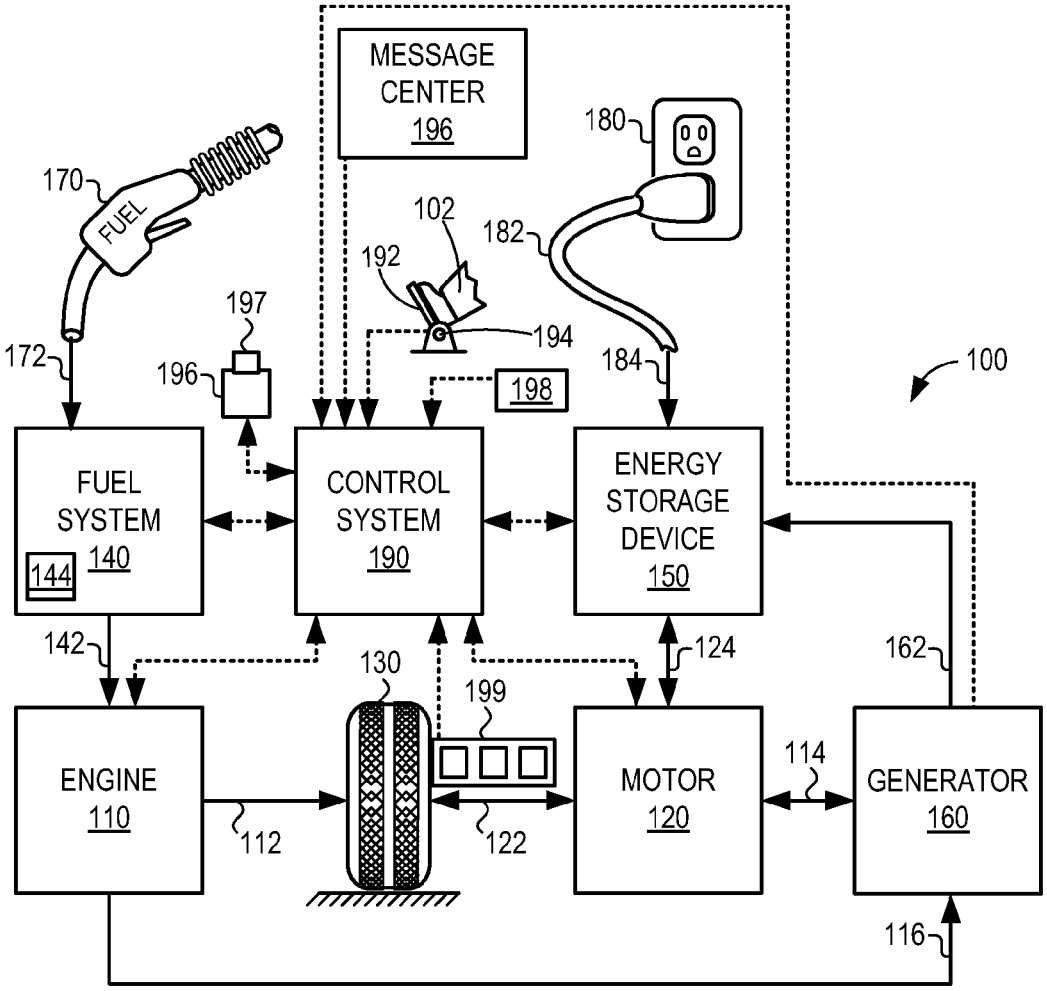

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIG. 4, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. Intake air may enter intake manifold 244 via one or more air filters 243. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. During canister purging, fuel vapors may first be desorbed from the canister (e.g., to a threshold amount) before being desorbed from the buffer. In other words, loading and unloading of the buffer is not necessarily linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve 292 coupled within vent line 227. As shown in FIG. 2, vent valve 292 is a multi-position valve, movable between a first, second, and third position, allowing for the selection of different pathways for fresh air entering the canister. The conformation of vent valve 292 may be regulated in conjunction with the position of reversing valve 293. Example configurations are described further herein and with regard to FIGS. 3A-3C. Briefly, vent line 227 may be coupled to reversing valve 293 via conduit 294 and junction 295. Purge line 228 may be coupled to vent valve 292 via conduit 296 and junction 297. In the configuration shown in FIG. 2, fresh air may enter canister 222 via vent line 227, and exit canister buffer 222*a* into purge line 228. In a second configuration, fresh air entering vent line 227 is ported through conduit 294 and reversing valve 293, entering canister buffer 222*a*, and exiting canister 222 via conduit 296.

The canister vent valve may operable such that under default conditions, the canister is fluidly coupled with atmosphere via vent line 227, such that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent line 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold. As described with regard to FIGS. 3A-3C and FIG. 4, the direction of the purge air flow may be reversed by altering the conformation of vent valve 292 and reversing valve 293, allowing for fresh air to desorb additional fuel vapors from canister 222 that may remain bound to adsorbent after purging in a first direction.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291, canister temperature sensor 232, manifold pressure sensor 268, and mass air flow sensor 269. Other sensors such as pressure, temperature, air/fuel ratio, and composition sensors may be coupled to various locations in the vehicle system 206. As another example, the actuators may include fuel injector 266, throttle 262, fuel tank isolation valve 253, and refueling lock 245. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 4.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Vent valve 292 may be placed in a third conformation, sealing the evaporative emissions system and decoupling the fuel vapor canister from atmosphere. This conformation is shown in FIG. 3C.

Turning to FIGS. 3A-3C, an evaporative emissions system 351 is shown in various conformations. Evaporative emissions system 351 comprises a fuel vapor canister 322 coupled to a fuel vapor canister buffer 322*a*. Fuel vapor canister buffer 322*a* is coupled to a fuel tank (not shown) via conduit 378. FTIV 352 is shown coupled within conduit 378, and may be operable to control the flow of fuel vapor out of the fuel tank. Fuel vapor canister buffer 322*a* is further coupled to an engine intake (not shown) via purge line 328. Purge valve 361 and reversing valve 393 are shown coupled within purge line 328, and may be operable to control the flow of fuel vapor from the fuel vapor canister to the engine intake. Fuel vapor canister 322 is coupled to atmosphere via vent line 327. Vent valve 392 is shown coupled within vent line 327, and may be operable to control the flow of fresh air into fuel vapor canister 322 and fuel vapor canister 322*a*. Vent line 327 is shown coupled to reversing valve 393 via conduit 394 and junction 395. Purge line 328 is shown coupled to vent valve 392 via conduit 396 and junction 397. The portion of vent line 327 located between junction 395 and atmosphere is designated as vent line segment 327*a* and may include an air filter (not shown). Fresh air may be drawn into vent line segment 327*a* at vent line inlet 330. The portion of purge line 328 located between reversing valve 393 and fuel vapor canister buffer 322*a* is designated as purge line segment 328*a*. Purge line segment 328*a* is coupled to fuel vapor canister buffer 322*a* at a first fuel vapor canister port 331. Vent line 327 is coupled to fuel vapor canister 322 at a second fuel vapor port 332. Conduit 333 is coupled to fuel vapor canister buffer 322*a* at a third fuel vapor port 333. Canister 322 may be coupled to one or more canister temperature sensors (not shown). Purge line 328 may be coupled to one or more oxygen sensors and/or one or more hydrocarbon sensors (not shown).

In FIG. 3A, vent valve 392 is shown in a first conformation and reversing valve 393 is shown in a first conformation. In this example, FTIV 352 may be considered closed, purge valve 361 may be considered open, and the intake manifold may comprise a vacuum sufficient to execute a purging operation. When vent valve 392 is in the first conformation, fuel vapor canister 322 is fluidly coupled to atmosphere via vent line 327 and vent line segment 327*a*. When reversing valve 393 is in the first conformation, fuel vapor canister buffer 322*a* is fluidly coupled to the engine intake via purge line 328 when purge valve 361 is open. As engine intake vacuum is applied to evaporative emissions system 351, fresh air enters vent line segment 327*a*, passing through vent valve 392 and vent line 327 into fuel vapor canister 322. Fresh air entering canister 322 will promote the desorption of adsorbed fuel vapor within canister 322 and within canister buffer 322*a*. The purge gasses, including the desorbed fuel vapor, will then enter purge line 328, passing through reversing valve 393 and purge valve 361 en route to engine intake.

As such, the configuration shown in FIG. 3A allows for fuel vapor canister purging via the flow path indicated by the dashed arrows. However, the flow of fresh air through canister 322 and buffer 322*a* may not be uniform. Accordingly, some regions of the canister and buffer will not be fully desorbed of fuel vapor following a purge operation. The residual hydrocarbons may contribute to bleed emissions. In order to generate forced airflow through the regions of the canister and buffer that are not fully desorbed, the direction of air flow through the canister may be reversed.

FIG. 3B shows vent valve 392 in a second conformation and reversing valve 393 in a second conformation. In this example, FTIV 352 may be considered closed, purge valve 361 may be considered open, and the intake manifold may comprise a vacuum sufficient to execute a purging operation. When in this configuration, fuel vapor canister buffer 322*a* is fluidly coupled to atmosphere via conduit 394 and vent line segment 327*a*, while fuel vapor canister 322 is fluidly coupled to intake via vent line 327, conduit 396 and purge line 328. As engine intake vacuum is applied to evaporative emissions system 351, fresh air enters vent line segment 327*a*, passing through junction 395 to conduit 394. The fresh air then passes through reversing valve 393 and purge line segment 328*a* into fuel vapor canister buffer 322*a*. In this way, the direction of air flow through the fuel vapor canister is reversed as opposed to the conformation shown in FIG. 3A, while the purge air intake is maintained at vent line inlet 330. Fresh air entering canister buffer 322*a* will promote the desorption of adsorbed fuel vapor within canister buffer 322*a* and within canister 322. Purge gasses, including the desorbed fuel vapor will then enter vent line 327 via port 332, passing through vent valve 392 into conduit 396. The purge gasses then passes through junction 397 and purge valve 361 into purge line 328 and on to the engine intake. In this way, although the direction of air flow through the canister is reversed when compared to the configuration shown in FIG. 3A, the delivery of purge gasses to engine intake is maintained.

FIG. 3C shows vent valve 392 in a third conformation and reversing valve 393 in a first conformation. In this example, purge valve 361 may be considered open, and the intake manifold may comprise a vacuum sufficient to execute a vacuum based leak test. While vent valve 392 is in the third conformation, vent line 327 is sealed, decoupling canister 322 from atmosphere. While purge valve 361 is open and reversing valve 393 is in the first conformation, a vacuum will be drawn on fuel vapor canister 322 and fuel vapor canister 322*a*. If the system pressure reaches a threshold, the system may be considered to be intact. If fuel tank isolation valve 352 is open, the vacuum will be drawn on the fuel tank.

Figure 4:
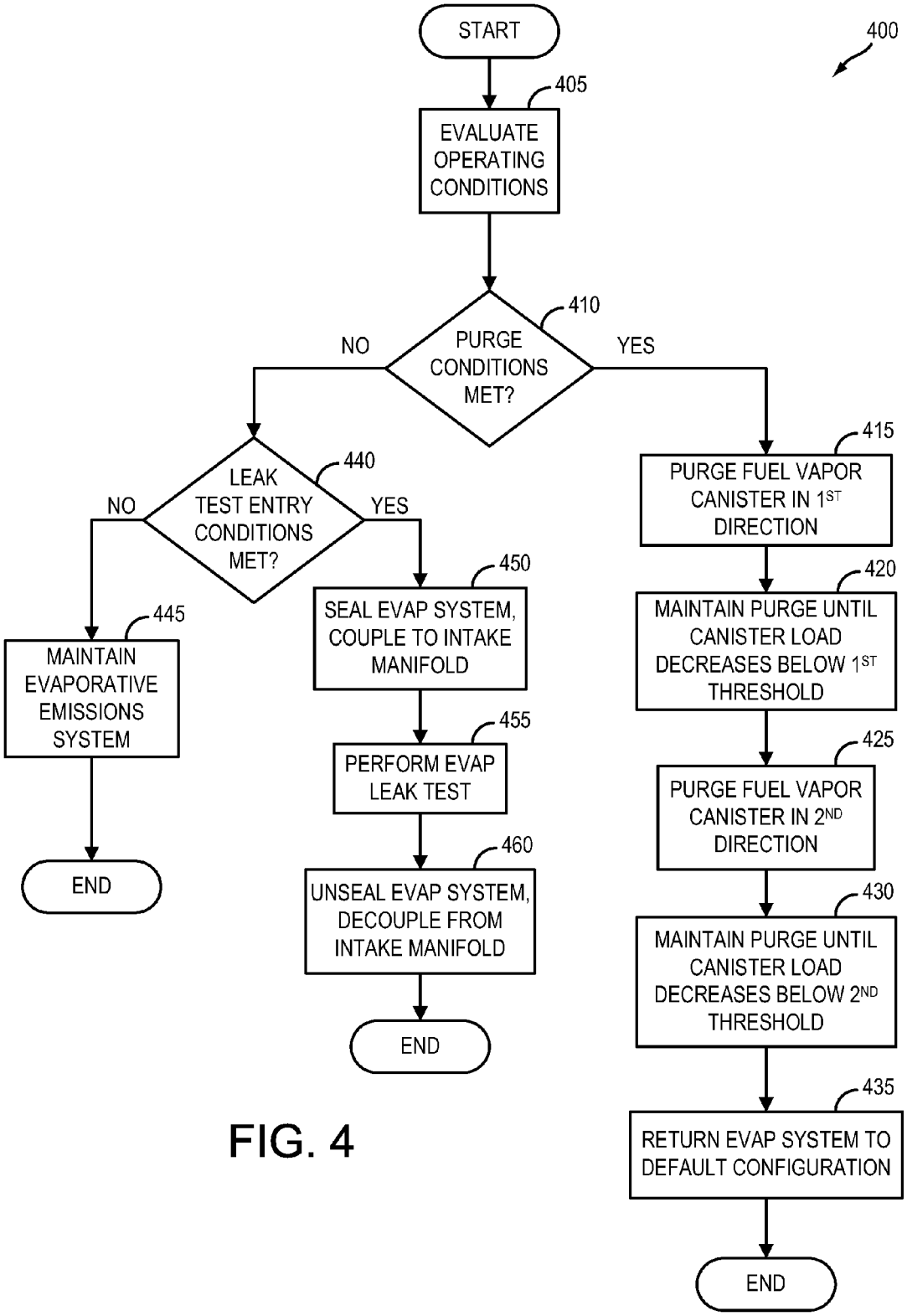
FIG. 4 shows a flow-chart for a high level method for purging a fuel vapor canister using the systems of FIGS. 2 and 3A-3C.
Figure 5:
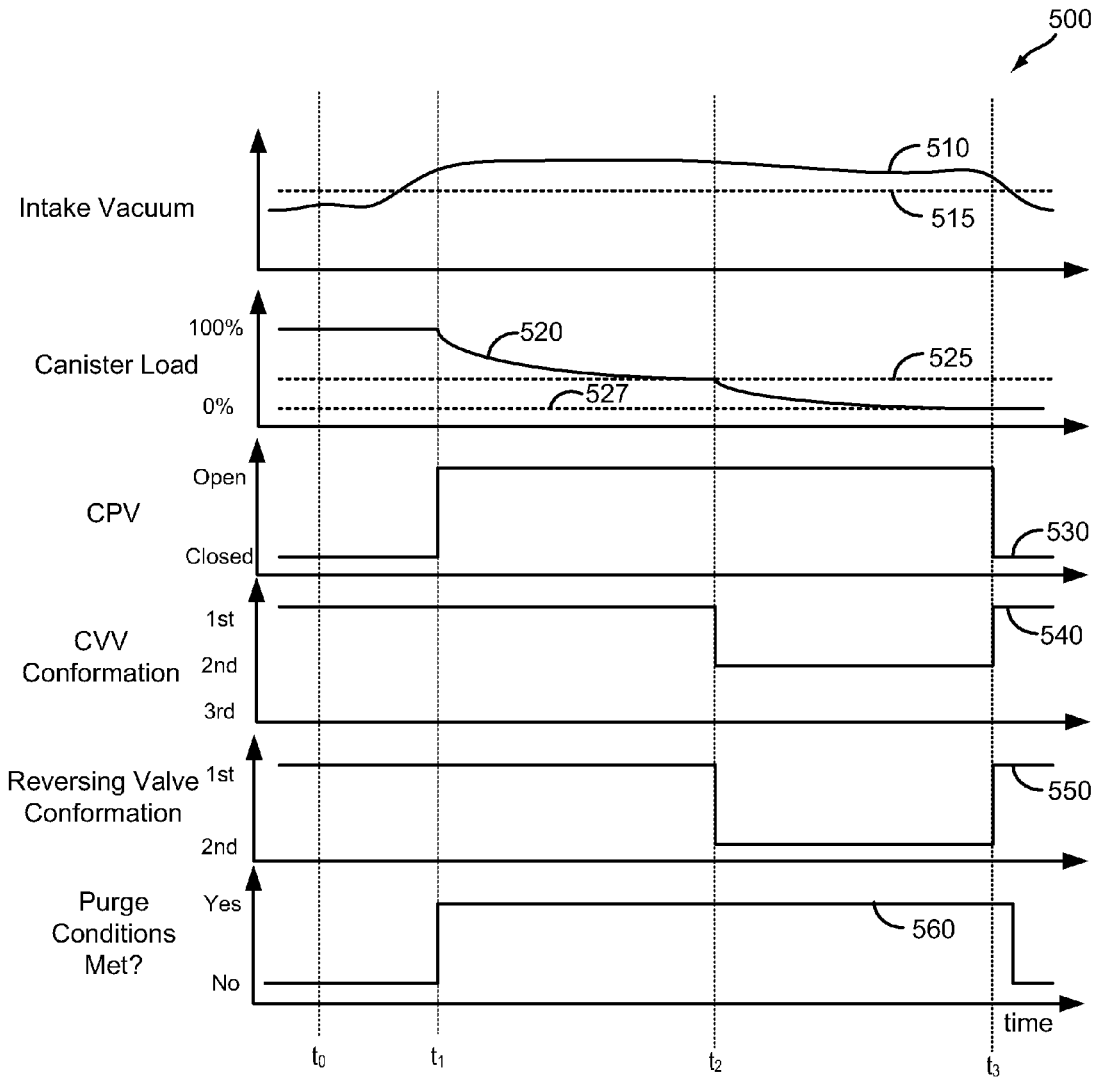
FIG. 5 shows an example timeline for vehicle operation using the method of FIG. 4.

FIG. 4 shows an example flow chart for a high-level method 400 for a canister purge routine in accordance with the present disclosure. Method 400 will be described in reference to the system described in FIGS. 3A-3C, though it should be understood that method 400 may be applied to other systems without departing from the scope of this disclosure. Method 400 may be carried out by a controller, and may be stored as executable instructions in non-transitory memory.

Method 400 may begin at 405. At 405, method 400 may include evaluating operating conditions. Operating conditions may be measured, estimated or inferred, and may include various vehicle conditions, such as vehicle speed and vehicle location, various engine operating conditions, such as engine operating mode, engine speed, engine temperature, exhaust temperature, boost level, MAP, MAF, torque demand, horsepower demand, canister load, etc., and various ambient conditions, such as temperature, barometric pressure, humidity, date, time, etc.

Continuing at 410, method 400 may include determining whether canister purge conditions are met. Purge conditions may include an engine-on condition, a canister load above a threshold, an intake manifold vacuum above a threshold, a non-steady state engine condition, and other operating conditions that would not be adversely affected by a canister purge operation.

If purge conditions are met, method 400 may proceed to 415. At 415, method 400 may include purging the fuel vapor canister in a first direction. Referring to FIG. 3A, purging the fuel vapor canister in a first direction may include drawing fresh air through vent line 327 such that the fresh air enters fuel vapor canister 322 and desorbed fuel vapor exits fuel vapor canister buffer 322*a* before flowing to the engine intake. Purging the fuel vapor canister in a first direction may include placing vent valve 392 in a first conformation, and may further include placing reversing valve 393 in a first conformation. CPV 361 may be opened, coupling the fuel vapor canister to engine intake, and FTIV 352 may be maintained closed.

Continuing at 420, method 400 may include maintaining the purge in the first direction until a canister load decreases below a first threshold. Additionally or alternatively, the purge may be maintained in the first direction until the concentration of fuel vapor exiting the fuel vapor canister decreases below a threshold. The canister load may be measured or inferred. For example, a canister temperature sensor may indicate a decrease in temperature while fuel vapor is being desorbed, and may plateau when fuel vapor is no longer being desorbed. An intake oxygen sensor or hydrocarbon sensor may indicate a change in air-fuel (A/F) ratio or otherwise indicate the content of air drawn through purge valve 361. An exhaust gas oxygen sensor may indicate a richness or leanness of the combustion mixture. In some examples, the purge may be maintained in the first direction for a duration, either a predetermined duration or a duration based on operating parameters such as canister load, ambient air temperature, intake manifold vacuum, etc.

Continuing at 425, method 400 may include purging the fuel vapor canister in a second direction. Referring to FIG. 3B, purging the fuel vapor canister in a second direction may include drawing fresh air through vent line 327 such that the fresh air enters fuel vapor canister 322*a* and desorbed fuel vapor exits fuel vapor canister 322 before flowing to the engine intake. Purging the fuel vapor canister in a second direction may include placing vent valve 392 in a second conformation, and may further include placing reversing valve 393 in a second conformation. CPV 361 may be maintained open while FTIV 352 may be maintained closed. In some examples, CPV 361 may be closed while the vent valve and reversing valves are being placed in their respective second conformations, and then re-opened.

Continuing at 430, method 400 may include maintaining the purge in the second direction until a canister load decreases below a second threshold, lower than the first threshold. As described at 420, canister load may be measured or inferred, intake A/F fuel ratio may indicate a plateau of fuel vapor desorption, and/or the purge may proceed for a duration. In some examples, following the purge in the second direction, additional purges in the first and/or second direction may take place. Continuing at 435, method 400 may include returning the EVAP system to a default configuration. This may include placing vent valve 392 in the first conformation, placing reversing valve 393 in the first conformation, and closing CPV 361. Method 400 may then end.

Returning to 410, if purge conditions are not met, method 400 may proceed to 440. At 440, method 400 may include determining whether entry conditions are met for an EVAP system leak test. Entry conditions may include a manifold vacuum above a threshold, an elapsed duration and/or engine run-time since a previous leak test, etc. If leak test entry conditions are not met, method 400 may proceed to 445. At 445, method 400 may include maintaining the evaporative emissions system status. Method 400 may then end.

If leak test entry conditions are met, method 400 may proceed to 450. At 450, method 400 may include sealing the evaporative emissions system and coupling the system to the intake manifold. Referring to FIG. 3C, sealing the evaporative emissions system may include placing vent valve 392 in a third conformation, and placing reversing valve 393 in a first conformation. The EVAP system may be coupled to the intake manifold by opening purge valve 361.

Continuing at 455, method 400 may include performing an EVAP leak test. This may include applying intake vacuum to the EVAP system for a duration, or until a system pressure, (e.g. a fuel vapor canister vacuum) reaches a threshold. A leak may be indicated based on the system pressure if the system pressure does not reach the threshold. In some examples, FTIV 352 may be opened for the duration of the leak test. In other examples, the FTIV may be closed for a portion of the leak test (canister side test) and opened for a different portion of the leak test (fuel tank side test). Continuing at 460, following completion of the leak test, method 400 may include unsealing the EVAP system and decoupling the system from the intake manifold. This may include returning vent valve 392 to a first conformation, and may further include closing purge valve 361. FTIV 352 may be closed if it was opened during the leak test. Method 400 may then end.

FIG. 5 shows a timeline 500 for an example canister purge operation using the system described herein and depicted in FIGS. 3A-3C along with the method described herein and depicted in FIG. 4. Timeline 500 includes plot 510, depicting intake manifold vacuum over time, while line 515 represents a vacuum threshold required as an entry condition for a canister purge operation. Timeline 500 further includes plot 520, indicating a canister load over time as a percentage of a fully loaded canister. Lines 525 and 527 represent first and second canister load thresholds. Timeline 500 further includes plot 530, indicating the status of a CPV over time. Timeline 500 further includes plot 540, indicating a conformation of a three-way vent valve over time, and plot 550, indicating a conformation of a reversing valve over time. Plot 500 further includes plot 560, indicating whether purge conditions are met over time.

At time $t_0$, the canister load is approaching 100%, as indicated by plot 520. However, intake manifold vacuum is below the threshold indicated by line 515. As such, purge conditions are not met, as indicated by plot 560. Accordingly, the CPV is closed, and the CVV and reversing valves are both in their respective first conformation, as shown by plots 530, 540, and 550, respectively.

At time $t_1$, intake vacuum is above a purge operation entry condition threshold, and purge conditions are met. Accordingly, a purge operation in a first direction may be initiated. The CVV is maintained in the first conformation, and the reversing valve is maintained in the first conformation. The CPV is opened, allowing fresh air to be drawn on the fuel vapor canister, and allowing desorbed fuel vapor to exit the fuel vapor canister buffer. As such, the canister load decreases, as indicated by plot 520.

At time $t_2$, the canister load reaches the first threshold indicated by line 525. As purge conditions are still met, a purge operation in a second direction may be initiated. The CPV is maintained open, while the CVV and reversing valves are placed in their respective second conformations. In this configuration, fresh air may be drawn on the fuel vapor canister buffer, and desorbed fuel vapor exits the fuel vapor canister. The canister load decreases, as indicated by plot 520. At time $t_3$, the canister load reaches the second threshold indicated by line 527. Accordingly, the purge operation may be completed, and the EVAP system returned to default conditions. The CPV is closed, and the CVV and reversing valves are returned to their respective first conformations.

The method described herein and depicted in FIG. 4, along with the systems described herein and depicted in FIGS. 1, 2, and 3A-3C may enable one or more systems and one or more methods. In one example, a method for purging a fuel vapor canister, comprising: responsive to a canister load decreasing below a first threshold, reversing a direction of air flow through the fuel vapor canister while maintaining purge air intake at a vent line inlet. Reversing the direction of air flow through the fuel vapor canister may further comprise: adjusting a conformation of a vent valve coupled between the fuel vapor canister and the vent line inlet and adjusting a conformation of a reversing valve coupled between a fuel vapor canister buffer and engine intake, such that purge air enters the fuel vapor canister through the fuel vapor canister buffer. Reversing the direction of air flow through the fuel vapor canister while maintaining purge air intake at a vent line inlet may further comprise reversing the direction of air flow though the fuel vapor canister while maintaining delivery of purge gasses to an engine intake. Reversing the direction of air flow through the fuel vapor canister while maintaining purge air intake at a vent line inlet may further comprise adjusting a conformation of the vent valve and adjusting a conformation of the reversing valve such that purge gasses exit the fuel vapor canister from a port that is not coupled to the fuel vapor canister buffer. The method may further comprise: responsive to a canister load decreasing below a second threshold, lower than the first threshold, restoring the direction of air flow through the fuel vapor canister. The technical result of implementing this method is an increase in purge efficiency, and accordingly a decrease in bleed emissions. Reversing the direction of air flow through the fuel vapor canister allows for canister regions that would normally retain fuel vapor during a purge event may realize increased desorption when the air flow direction is reversed.

In another example, a method for purging a fuel vapor canister, comprising: coupling a first fuel vapor canister port to an engine intake; coupling a second fuel vapor canister port to a fresh air source; opening a canister purge valve coupled between the first fuel vapor canister port and the engine intake; and responsive to a fuel vapor canister load decreasing below a first threshold, coupling the second fuel vapor canister port to the engine intake and coupling the first fuel vapor canister port to the fresh air source. Coupling the first fuel vapor canister port to an engine intake may further comprise: placing a reversing valve coupled between the fuel vapor canister and the engine intake in a first conformation. Coupling the second fuel vapor canister port to the fresh air source may further comprise: placing a canister vent valve coupled between the fuel vapor canister and the fresh air source in a first conformation. Coupling the second fuel vapor canister port to the engine intake and coupling the first fuel vapor canister port to the fresh air source may further comprise: placing the reversing valve in a second conformation; and placing the canister vent valve in a second conformation. The first fuel vapor canister port may be coupled to a fuel vapor canister buffer, and the second fuel vapor canister port may not be coupled to the fuel vapor canister buffer. Placing the reversing valve in the second conformation and placing the canister vent valve in the second conformation may reverse a direction of air flow through the fuel vapor canister compared to placing the reversing valve in the first conformation and placing the canister vent valve in the second conformation. The method may further comprise: during a first condition, closing the canister purge valve prior to coupling the second fuel vapor canister port to the engine intake. In some examples, the method may further comprise: during a second condition, maintaining the canister purge valve open while coupling the second fuel vapor canister port to the engine intake; and adjusting an air-fuel ratio responsive to a flow of purge gasses while the second fuel vapor canister port is coupled to the engine intake. The method may further comprise: responsive to the fuel vapor canister load decreasing below a second threshold, lower than the first threshold, coupling the first fuel vapor canister port to the engine intake; and coupling the second fuel vapor canister port to the fresh air source. The technical result of implementing this method is an increased uniformity in fuel vapor purging throughout the canister. This may prevent a canister "heel" from retaining fuel vapor during purge events, as air flow to some regions of the canister will be increased in the reverse direction. This may, in turn, increase the effective life of the fuel vapor canister.

In yet another example, a system for an engine, comprising: a fuel vapor canister comprising a fuel vapor canister buffer; a purge line coupling the fuel vapor canister to an engine intake via a canister purge valve; a vent line coupling the fuel vapor canister to a fresh air source; a canister vent valve coupled between the fuel vapor canister and the vent line, the canister vent valve operable between a first conformation and a second conformation; a reversing valve coupled between the fuel vapor canister buffer and the purge line, the reversing valve operable between a first conformation and a second conformation; and a controller comprising instructions stored in non-transitory memory, that when executed, cause the controller to: draw air through the fuel vapor canister with the canister vent valve in the first conformation and with the reversing valve in the first conformation; responsive to a fuel vapor canister load decreasing below a first threshold, draw air through the fuel vapor canister with the canister vent valve in the second conformation and with the reversing valve in the second conformation; and responsive to the fuel vapor canister load decreasing below a second threshold, lower than the first threshold, ceasing drawing air through the fuel vapor canister. Drawing air through the fuel vapor canister may further comprise: opening the canister purge valve. The canister vent valve may be further configured to: couple the fresh air source to the fuel vapor canister when in the first conformation; couple the fresh air source to the reversing valve when in the second conformation; and couple the fuel vapor canister to the purge line when in the second conformation. The reversing valve may be further configured to: couple the fuel vapor canister buffer to the purge line when in the first conformation; and couple the fuel vapor canister buffer to the vent line when in the second conformation. The canister vent valve may be operable to a third conformation, where the canister vent valve seals the fuel vapor canister from the fresh air source. In some examples, the controller may further comprise instructions stored in non-transitory memory, that when executed, cause the controller to: responsive to an fuel vapor canister leak check condition, place the canister vent valve in the third conformation; place the reversing valve in the first conformation; open the canister purge valve; and indicate a leak in the fuel vapor canister based on a fuel vapor canister vacuum. The technical result of implementing this system is a reduction in bleed emissions without requiring additional elements which may increase manufacturing costs, such as a canister heater or secondary bleed canister.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for purging a fuel vapor canister coupled to an engine intake and a vent line inlet, comprising:

with a controller, responsive to a canister load decreasing below a first threshold, reversing a direction of air flow through the fuel vapor canister via an actuator while maintaining purge air intake at the vent line inlet and purge gas delivery to the engine intake, the fuel vapor canister load being determined from sensed conditions.

2. The method of claim 1, where reversing the direction of air flow through the fuel vapor canister further comprises:

adjusting a conformation of a vent valve coupled between the fuel vapor canister and the vent line inlet and adjusting a conformation of a reversing valve coupled between a fuel vapor canister buffer and the engine intake, such that purge air enters the fuel vapor canister through the fuel vapor canister buffer.

3. The method of claim 2, where reversing the direction of air flow through the fuel vapor canister while maintaining purge air intake at the vent line inlet further comprises:

adjusting the conformation of the vent valve and adjusting the conformation of the reversing valve such that purge gasses exit the fuel vapor canister from a port not coupled to the fuel vapor canister buffer.

4. The method of claim 1, further comprising:

responsive to the canister load decreasing below a second threshold, lower than the first threshold, restoring the direction of air flow through the fuel vapor canister.

5. A method for purging a fuel vapor canister, comprising:

coupling a first fuel vapor canister port to an engine intake;

coupling a second fuel vapor canister port to a fresh air source;

opening a canister purge valve coupled between the first fuel vapor canister port and the engine intake, such that air flows through the fuel vapor canister in a first direction; and with a controller, responsive to a fuel vapor canister load decreasing below a first threshold, reversing a direction of airflow within the fuel vapor canister by coupling the second fuel vapor canister port to the engine intake and coupling the first fuel vapor canister port to the fresh air source with actuators, the fuel vapor canister load being determined from operating conditions determined from sensors.

6. The method of claim 5, where coupling the first fuel vapor canister port to the engine intake further comprises:

placing a reversing valve coupled between the fuel vapor canister and the engine intake in a first conformation.

7. The method of claim 6, where coupling the second fuel vapor canister port to the fresh air source further comprises:

placing a canister vent valve coupled between the fuel vapor canister and the fresh air source in a first conformation.

8. The method of claim 7, where coupling the second fuel vapor canister port to the engine intake and coupling the first fuel vapor canister port to the fresh air source further comprises:

placing the reversing valve in a second conformation; and placing the canister vent valve in a second conformation.

9. The method of claim 5, where the first fuel vapor canister port is coupled to a fuel vapor canister buffer, and where the second fuel vapor canister port is not coupled to the fuel vapor canister buffer.

10. The method of claim 8, where placing the reversing valve in the second conformation and placing the canister vent valve in the second conformation reverses the direction of air flow through the fuel vapor canister compared to placing the reversing valve in the first conformation and placing the canister vent valve in the second conformation.

11. The method of claim 5, further comprising:

during a first condition, closing the canister purge valve prior to coupling the second fuel vapor canister port to the engine intake.

12. The method of claim 11, further comprising:

during a second condition, maintaining the canister purge valve open while coupling the second fuel vapor canister port to the engine intake; and adjusting an air-fuel ratio responsive to a flow of purge gasses while the second fuel vapor canister port is coupled to the engine intake.

13. The method of claim 5, further comprising:

responsive to the fuel vapor canister load decreasing below a second threshold, lower than the first threshold, coupling the first fuel vapor canister port to the engine intake; and coupling the second fuel vapor canister port to the fresh air source.

14. A system for an engine, comprising:

a fuel vapor canister comprising a fuel vapor canister buffer;

a purge line coupling the fuel vapor canister to an engine intake via a canister purge valve;

a vent line coupling the fuel vapor canister to a fresh air source;

a canister vent valve coupled between the fuel vapor canister and the vent line, the canister vent valve operable between a first conformation and a second conformation;

a reversing valve coupled between the fuel vapor canister buffer and the purge line, the reversing valve operable between a first conformation and a second conformation; and a controller comprising instructions stored in non-transitory memory, that when executed, cause the controller to:

draw air through the fuel vapor canister with the canister vent valve in the first conformation and with the reversing valve in the first conformation;

responsive to a fuel vapor canister load decreasing below a first threshold, draw air through the fuel vapor canister with the canister vent valve in the second conformation and with the reversing valve in the second conformation, the fuel vapor canister load being determined from operating conditions; and responsive to the fuel vapor canister load decreasing below a second threshold, lower than the first threshold, ceasing drawing air through the fuel vapor canister.

15. The system of claim 14, where drawing air through the fuel vapor canister further comprises:

opening the canister purge valve.

16. The system of claim 14, where the canister vent valve is further configured to:

couple the fresh air source to the fuel vapor canister when in the first conformation;

couple the fresh air source to the reversing valve when in the second conformation; and couple the fuel vapor canister to the purge line when in the second conformation.

17. The system of claim 16, where the reversing valve is further configured to:

couple the fuel vapor canister buffer to the purge line when in the first conformation; and couple the fuel vapor canister buffer to the vent line when in the second conformation.

18. The system of claim 14, where the canister vent valve is operable to a third conformation, where the canister vent valve seals the fuel vapor canister from the fresh air source.

19. The system of claim 18, where the controller further comprises instructions stored in non-transitory memory, that when executed, cause the controller to:

responsive to an fuel vapor canister leak check condition, place the canister vent valve in the third conformation;

place the reversing valve in the first conformation;

open the canister purge valve; and indicate a leak in the fuel vapor canister based on a fuel vapor canister vacuum.

20. The system of claim 14, wherein the fuel vapor canister load being determined from operating conditions includes one of measuring oxygen using a sensor, measuring hydrocarbons using a sensor, inferring from fuel vapor canister temperature, or inferring from an intake air to fuel ratio.

* * * * *